United States Patent [19]

Ishii

[11] Patent Number: 4,471,949

[45] Date of Patent: Sep. 18, 1984

[54] HOT ISOSTATIC PRESSING SYSTEM

[75] Inventor: Takahiko Ishii, Kobe, Japan

[73] Assignee: Kabushiki Kaishi Kobe Seiko Sho, Kobe, Japan

[21] Appl. No.: 484,315

[22] Filed: Apr. 12, 1983

[30] Foreign Application Priority Data

Apr. 13, 1982 [JP] Japan ..... 57-54564

[51] Int. Cl.[3] ..... B22F 3/00; C21C 9/00

[52] U.S. Cl. ..... 266/252; 425/405 H; 266/250

[58] Field of Search ..... 266/252, 250, 255; 425/78, 405 H; 432/247, 249

[56] References Cited

U.S. PATENT DOCUMENTS

| | | | |
|---|---|---|---|
| 3,548,062 | 12/1970 | Smith, Jr. | 266/252 |
| 3,752,456 | 8/1973 | Larker | 266/252 |
| 4,022,446 | 5/1977 | Smith et al. | 266/252 |
| 4,217,087 | 8/1980 | Bowles | 425/78 |
| 4,238,667 | 12/1980 | Conaway | 425/405 H |
| 4,279,581 | 7/1981 | Betz | 425/78 |

FOREIGN PATENT DOCUMENTS

| | | | |
|---|---|---|---|
| 2135255 | of 1972 | France | 425/405 H |
| 124610 | of 1976 | Japan . | |

*Primary Examiner*—L. Dewayne Rutledge
*Assistant Examiner*—Christopher W. Brody
*Attorney, Agent, or Firm*—Oblon, Fisher, Spivak, McClelland & Maier

[57] ABSTRACT

A HIP system of the type which includes a high pressure vessel with top and bottom plugs for closing top and bottom open ends thereof or a high pressure vessel closed at one end and having a plug for closing the other open end thereof, and a high pressure and temperature processing chamber defined in the pressure vessel and having a heat insulating mantle and a heater disposed around the inner periphery thereof for subjecting a workpiece supported on the plug to sintering or other treatment in a high pressure and temperature gas atmosphere, the HIP system including: a removable shield casing hermetically engageable with the workpiece supporting plug and adapted to be loaded into and unloaded from the high pressure vessel along with the workpiece, holding the processing chamber in a sealed state; and a valve member provided in the shield casing for selectively establishing and blocking communication of the processing chamber with an exterior atmosphere such that the processing chamber is selectively placed in a vacuumized state, filled with a high pressure gas and evacuated to an atmospheric pressure.

9 Claims, 10 Drawing Figures

HOT ISOSTATIC PRESSING SYSTEM

BACKGROUND OF THE INVENTION

Field of the Invention

This invention relates to the so-called hot isostatic pressing system (hereinafter referred to simply as "HIP" for brevity) generally used for sintering powdery material, and more particularly to a modular HIP system which can realize a marked improvement in productivity.

Description of the Prior Art

Various techniques have thus far been developed in the sphere of the hot isostatic compaction process wherein a workpiece is processed in a high pressure and temperature gas atmosphere for sintering or for other treatment in a processing chamber of a pressure cylinder with a closure plug or plugs at an open end or ends thereof and having a heat insulating mantle provided in the processing chamber along with a heater located on the inner side of the mantle. For example, in a case where the HIP techniques are resorted to for shaping and sintering a powdery material, it becomes possible to attain a higher densification at lower temperatures, a density close to the theoretical value and to secure a finer and more uniform texture as compared with the conventional sintering means, coupled with various advantages such as improvements in the mechanical and physical properties of the powder, the feasibility of shaping powder materials unsuitable for die forming, the ability to form large products without the limitation as imposed by the press capacity in the case of ordinary die forming presses, the shaping of composite materials such as of a metal and ceramics, an improvement in the yield of the material, etc. In addition to the shaping and sintering of powder materials, the HIP process can be utilized for other purposes.

In spite of the above-mentioned various advantages, the HIP process has a serious problem that it is extremely low in productivity, so that there have thus far been made various attempts to shorten the cycle time period and to improve the efficiency of operation and use of the HIP system as a whole, including Applicant's Japanese Laid-Open Patent Specification No. 51-124610 disclosing an improved HIP method and a HIP system therefor.

SUMMARY OF THE INVENTION

The present invention has been achieved as a result of a continued study in this regard, and has as its object the provision of a modular type furnace unit which can load and unload a workpiece in a facilitated manner into and out of a high pressure vessel consisting of a high pressure cylinder with upper and lower closure plugs at the upper and lower open ends of a high pressure cylinder closed at one end and having a closure at the other open end, and which can cool and preheat the workpiece outside the high pressure vessel of the HIP system for enhancing the productivity of the system to a significant degree.

According to the present invention, there is provided a HIP system of the type which includes a high pressure vessel with top and bottom plugs for closing top and bottom open ends thereof or a high pressure vessel closed at one end and having a plug for closing the other open end thereof, and a high pressure and temperature processing chamber defined in the pressure vessel and having a heat insulating mantle and a heater disposed around the inner periphery thereof for subjecting a workpiece supported on the plug to sintering or other treatment in a high pressure and temperature gas atmosphere, the HIP system comprising: a shield casing hermetically engageable with the workpiece-supporting plug and adapted to be loaded into and unloaded from the high pressure vessel along with the workpiece, holding the processing chamber in a sealed state; and a valve member provided in the shield casing for selectively establishing and blocking communication of the processing chamber with an exterior atmosphere.

The above and other objects, features and advantages of the present invention will become apparent from the following description and the appended claims, taken in conjunction with the accompanying drawings which show by way of example some illustrative embodiments of the invention and in which like component parts are designated by like reference numerals throughout various figures.

DETAILED DESCRIPTION OF THE PREFERRED EMBODIMENTS

Figure 1:
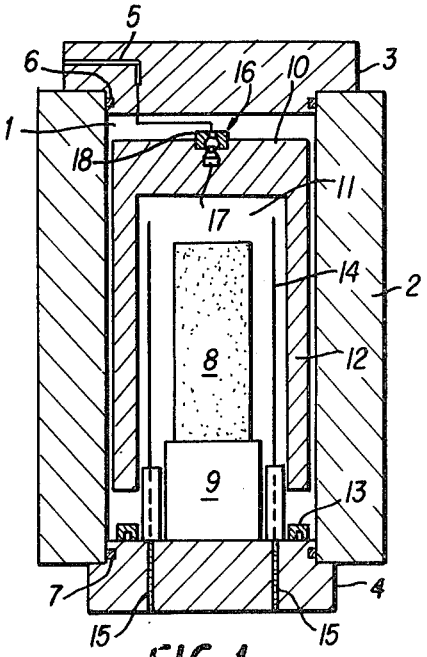
FIG. 1 is a vertically sectioned elevational view of a bottom loading type modular furnace construction according to the present invention.

Referring to the accompanying drawings and first to FIG. 1, there is shown a high pressure vessel/furnace according to the present invention, including a pressure cylinder 2 and upper and lower plugs 3 and 4 for closing the upper and lower open ends of the pressure cylinder 2, respectively, to define a high pressure chamber 1 therein. The gas which is admitted into the high pressure chamber 1 through a pressure inlet passage 5 in the upper plug 3 is retained in sealed state in the high pressure chamber 1 by upper and lower seal rings 6 and 7. In this instance, the axial force which acts against the upper and lower plugs 3 and 4 are supported by threaded engagement of the upper and lower plugs 3 and 4 with the pressure cylinder or with the aid of a press mechanism.

Figure 2:
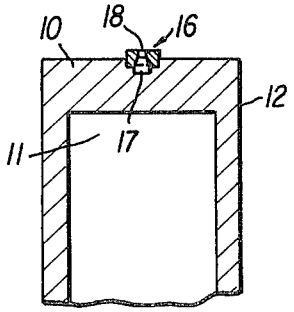
FIG. 2 is a fragmentary vertical sectional view showing a valve member in closed state.

The lower plug 4 is provided with a mounting block 9 for supporting a workpiece 8 and defines a high pressure and temperature processing chamber 11 in cooperation with a heat insulating mantle 10, holding the workpiece 8 in the processing chamber 11. The insulating mantle 10 is formed in an inverted cup-like shape from a fibrous heat insulating material such as ceramic fibre, and retained in a shield casing 12 of a similar shape as shown in the figure. The lower end of the casing 12 is hermetically placed on the lower plug 4 by means of a seal ring 13, and is releasable from the lower plug 4 when necessary. The heat insulating mantle 10 is provided with a heater 14 on the inner side thereof, which heater 14 employs, for example, a conduction heater as a heating element which is held in position on the lower plug 4 by means of electrically insulating retaining members (not shown). Electric power is supplied to the heater 14 through electrodes 15 which are provided in the lower plug 4 in an electrically insulated and hermetically sealed state. In the particular embodiment shown in FIG. 1, a valve 16 is provided on top wall of the shield casing 12 which opposes the upper plug 3. The valve member 16 establishes and blocks communication between the high pressure and temperature processing chamber 11 and the atmosphere, and mainly consists of a valve body 17 and a valve port 18 to be opened and closed by the valve body 17. The construction of the valve 16 will be described in greater detail hereinbelow. When the valve port 18 is uncovered by the valve body 17 as shown in FIG. 1, it is possible to admit the gas through the pressure inlet passage 5 in the upper plug 3 for supply to the processing chamber 11 through the valve port 18 and heat insulating mantle 10, or to replace the gas in the processing chamber 11. On the other hand, when the valve 16 is closed as shown in FIG. 2, the high pressure and temperature processing chamber 11 is completely shielded off from the outside.

Figure 3:
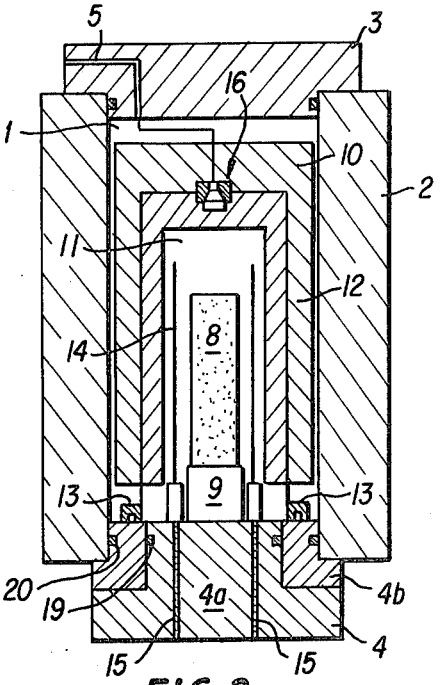
FIG. 3 is a vertically sectioned elevational view of a furnace unit according to the present invention, employing a shield casing of a modified construction.
Figure 4:
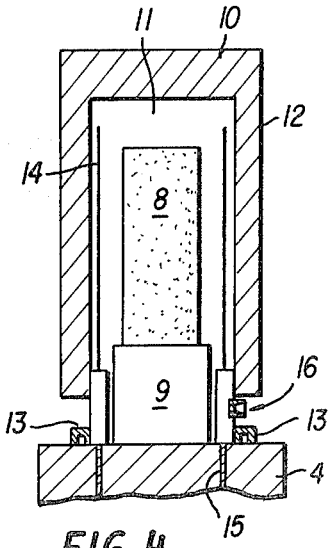
FIG. 4 is a fragmentary vertical section showing a modification of the valve member.

Reference is now had to FIGS. 3 and 4 which illustrate further embodiments of the present invention. In the embodiment of FIG. 3, the shield casing 12 is placed within the heat insulating mantle 10, with the lower end of the casing 12 hermetically placed on a lower plug 4 of a double wall construction. More specifically, in this case the lower plug 4 consists of an inner plug 4*a* which is provided with a plateau portion 9 for mounting a workpiece 8, and an outer plug 4*b* which is fitted around the inner plug 4*a* on its inner periphery and fitted in the pressure cylinder 2 on its outer periphery. The lower end of the shield casing 12 is hermetically placed on the outer plug 4*b* via a seal ring 13. Denoted at 19 and 20 are seal rings which provide a seal between the inner and outer plugs 4*a* and 4*b* and between the pressure cylinder 2 and the outer plug 4*b*, respectively. When the shield casing 12 is provided on the inner side of the heat insulating mantle 10 in this manner, the valve 16 also provided on the top wall of the casing 12 beneath the upper plug 3 is similar to the above-described first embodiment. It is to be understood that the same effects are obtained even if the shield casing 12 is provided within the heat insulating mantle 10 and the lower plug 4 is formed of a double plug construction as in the present embodiment.

The embodiment of FIG. 4 employs a lower plug 4, a heat insulating mantle 10 and a heater 14 similar to the embodiment of FIG. 1. However, in this embodiment, the valve 16 for the shield casing 12 is provided on the lower peripheral wall of the casing 12 as shown in the figure. As will be understood, the valve 16 may be at any arbitrary position on the casing 12 to perform the above-described operation.

Figure 5:
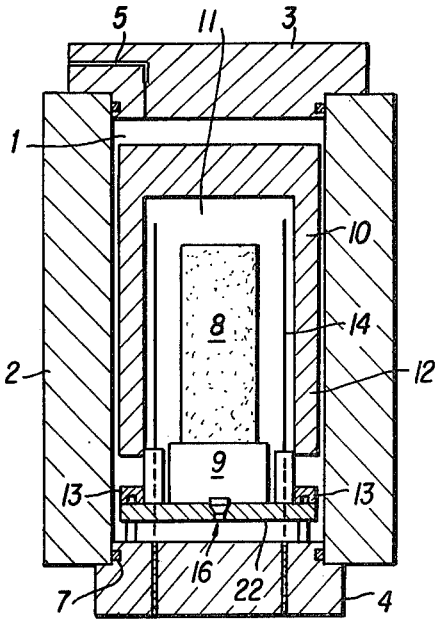
FIG. 5 is a vertically sectioned elevational view of a top loading type furnace unit according to the present invention.

Referring to FIG. 5, there is shown another embodiment applying the present invention to a top loading type which is adapted to remove the upper plug 3 for loading and unloading a workpiece 8 together with the heating insulating mantle 10 through the upper opening of pressure cylinder 2, in contrast to the embodiments of FIGS. 1 to 4 in which the heat insulating mantle 10, heater 14 and workpiece 8, supported on the lower plug 4, are loaded and unloaded through the lower opening of the pressure cylinder 2. As seen in FIG. 4, a lower seal plate 22 is mounted on the lower plug 4 through a support member 21 to serve as part of the shield casing 12, mounted with the lower end of the shield casing 12 on the lower seal plate 22 through a seal ring 13, and a valve 16 is provided in the seal plate 22 to selectively communicate the interior of the high pressure and temperature processing chamber 11 with the atmosphere.

Figure 6:
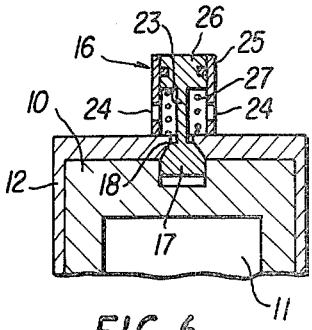
FIGS. 6 and 7 are sectional views showing an exemplary construction of an automatic valve lifter holding the valve member in open and closed states, respectively.
Figure 7:
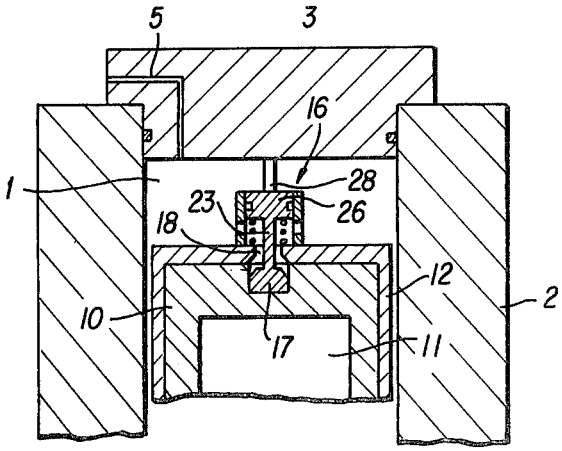

FIGS. 6 and 7 illustrate an exemplary construction of the valve 16 (an example which is provided in the top wall of the shield casing 12 beneath the top plug 3 as in the embodiment of FIG. 1). The valve body 17 which opens and closes the valve port 18 in the casing 12 is provided on stem 23 thereof a guide which is slidably fitted in a cylindrical casing 25 with an aperture 24. The valve stem 23 is constantly urged upward by a spring 27 to hermetically seal the valve port 18 with the valve body 17. As the shield casing 12 is inserted into the pressure chamber 1 of the container together with the heat insulating mantle 10, as shown particularly in FIG. 7, the guide 26 is depressed by a valve pressing member 28 which is provided on the part of upper plug 3, lowering the valve stem 23 and valve body 17 against the action of the spring 27 to uncover the valve port 18 and to communicate the high pressure chamber 1 with the processing chamber 11 through the aperture 24 and valve port 18. Of course, the abovedescribed valve opening and closing mechanism only constitutes an example and there may be employed a motor-driven mechanism or other arrangement. In any event, it is convenient to use a mechanism which is adapted to open and close the valve 16 automatically in relation with the loading and unloading operations into and out of the high pressure container.

Although a single valve 16 is provided in the shield casing 12 in the foregoing embodiments, it is possible to provide a pair of side by side similar valves which operate in an inverse fashion relative to each other.

Figure 8:
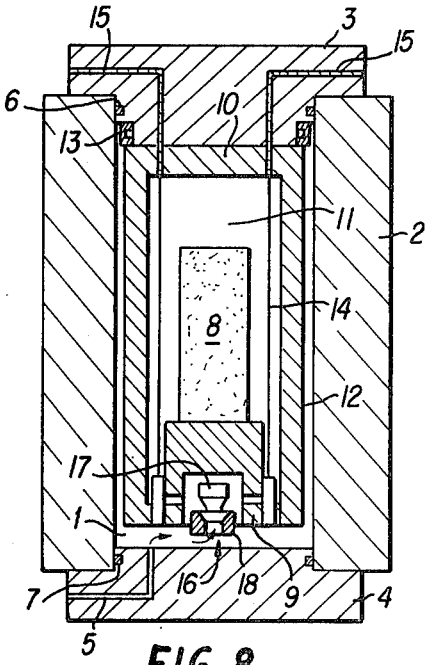
FIGS. 8 to 10 are vertically sectioned elevational views of further embodiments of the present invention.

FIG. 8 illustrates a further modification of the pressure container/furnace construction according to the present invention, which is the same as the embodiment of FIG. 1 except that the heater 14 is supported on part of the upper plug 3 through electrodes 15 or other suitable means, and in which like component parts are designated by like reference numerals to avoid repetition of explanation.

Figure 9:
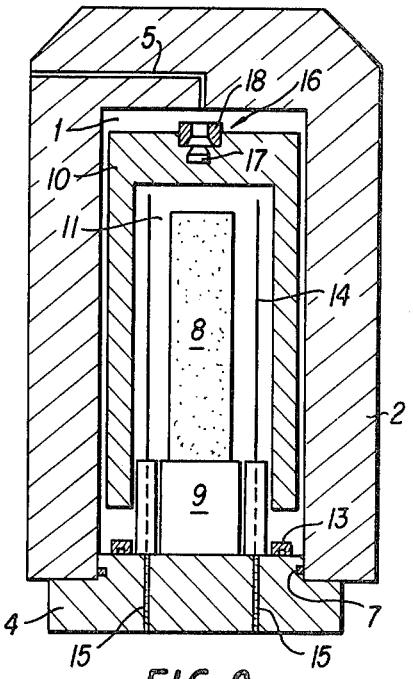

FIG. 9 shows another modification which is the same as the foregoing embodiment except that the pressure container 2 is closed at the top end by an integrally formed top wall, and in which like component parts are also denoted by like reference numerals.

Figure 10:
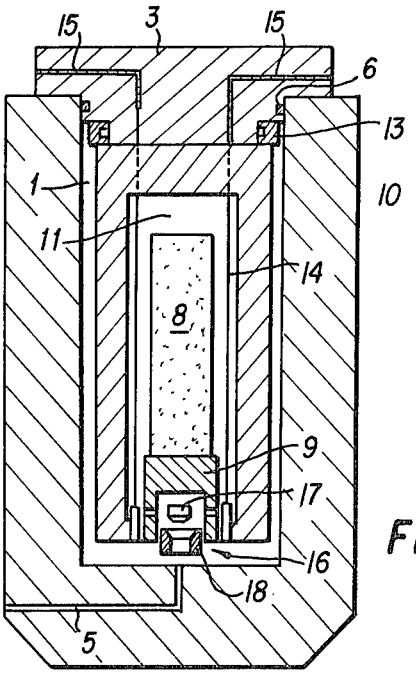

Shown in FIG. 10 is a further modification employing a pressure container 2 which is closed at its lower end by an integrally formed bottom wall, with the electrodes 15 and a heater 14 being mounted on the upper plug 3. In this figure, the component parts which are common to the foregoing embodiments are also designated by like reference numerals.

With the above-described modular furnaces according to the present invention, a HIP system can be operated in an extremely efficient manner. More specifically, to explain the operation by way of the embodiment shown in FIG. 1, the heat insulating mantle 10, heater 14 and lower plug 4 with the workpiece 8 on its mounting block 9 can be placed into and removed out of the pressure cylinder 2 in an assembled state through the lower open end of the cylinder 2. In this case, the outer shell of the heat insulating mantle 10 serves as a shield casing 12 with its lower end hermetically coupled with the lower plug 4 by the seal ring 13 to maintain the high pressure and temperature processing chamber 11 in a sealed state. The shield casing 12 is provided with a valve 16, for example of the construction as shown in FIGS. 6 and 7, which is opened upon loading the high pressure chamber 1 to communicate the same with the processing chamber 11, permitting suctioning under a vacuum of the high pressure chamber 1 and processing chamber 11 through the gas inlet passage 5 in the upper plug 3 prior to gas replacement. After the gas replacement, the gas is continuously supplied to the chambers 1 and 11 through the pressure inlet passage 5, while electric power is applied to the heater 14 through the electrodes 15 embedded in the lower plug 4, thereby applying pressure and heat to shape the workpiece in a high pressure and temperature gas atmosphere. In this instance, by the communication of the high pressure chamber 1 with the processing chamber 11 through the opened valve 16, a pressure of, for example, 1000–2000 atms. can be applied to the feed gas without causing a pressure differential across the shield casing 12, allowing the HIP operation to proceed in a uniformly (iso) pressurized state. Upon completing a required forming operation in this manner, the high gas pressure is drained through the pressure inlet passage 5 to lower the pressure in the chambers 1 and 11 to atmospheric pressure. Thereafter the lower plug 4 is discharged from the pressure cylinder 2 through the lower open end together with the workpiece 8, heater 14, heat insulating mantle 10 and shield casing 12, whereupon, the valve port 18 is automatically closed by the valve body 17 by the use of the valve construction shown in FIGS. 6 and 7, maintaining the processing chamber 11 of the atmospheric pressure in a sealed state. In the meantime, the power supply to the heater 14 is cut off at an arbitrary time point after completion of the HIP treatment to let the workpiece 8 cool off.

The lower plug 4, workpiece 8, heater 14, heat insulating mantle 10 and shield casing 12 which are removed from the high pressure container in an assembled state are transferred altogether to a predetermined spot by a transfer means, and, when the processing chamber 11 is cooled down to a temperature below a predetermined level, the shield casing 12 is detached from the lower plug 4 together with the heat insulating mantle 10, opening the processing chamber 11 to replace the processed workpiece 8 on the mounting block 9 with a fresh workpiece. Thereafter, the shield casing 12 and heat insulating mantle 10 are fitted on the lower plug 4 to shield the processing chamber 11, and the valve body 17 of the valve 16 is opened to suction the processing chamber 11 under a vacuum or to create a desired atmosphere of a particular gas therein by gas replacement. The valve body 17 is then closed on the valve port 18 to restore the sealed state and power is applied to the heater 14 to preheat the freshly loaded workpiece 8 to a predetermined level. After the preheating, the workpiece 8 on the lower plug 4 is transferred toward the high pressure container together with the shield casing 12, heat insulating mantle 10 and heater 14 and inserted into the pressure cylinder 2 via its lower open end. Upon fixing the lower plug 4 to the high pressure container, the valve 16 is automatically opened by the valve opening mechanism in the same manner as described hereinabove to communicate the processing chamber 11 with the pressure chamber 1, repeating the same cycle of operation including suctioning under vacuum or gas replacement of the chambers 1 and 11 through the pressure inlet passage 5, continuous feed and pressure elevation of the replacing gas, isostatic pressurization of the chambers 1 and 11 and heat application by the heater 14 to process the workpiece 8 in a high pressure and temperature gas atmosphere.

According to the present invention, the high pressure and temperature processing chamber 11 including the heat insulating mantle 10 and heater 14 are hermetically enclosed in the shield casing 12 in the above-described cycle of operation, and the shield casing 12 is provided with a valve 16 for selectively establishing and blocking communication of the processing chamber 11 with the outside. Therefore, during the forming operation in a high pressure and temperature gas atmosphere, the processing chamber 11 is communicated with the high pressure chamber 1 of the container to maintain isostatic pressurization without any pressure differential therebetween to ensure a smooth forming operation. The processing chamber 11 is securely shielded in an atmosphere of a particular gas, for example, in an atmosphere of an inert gas when unloaded from the high pressure chamber 1, so that it can be immediately taken out of the high pressure container 2 upon completion of the HIP process even if the workpiece 8 is of a nature which can not be exposed to the atmosphere at a high temperature, like ferrite and ultrahard alloys, and transferred to a workpiece unloading/loading station without any difficulty occurring. Consequently, one high pressure container can be alternately used by a plurality of modular furnace units including the lower plug 4, heat insulating plug 10, heater 14 and shield casing 12, and the residence time of each modular furnace unit in the high pressure chamber 1 is shortened, permitting considerable enhancement of the efficiency of utilization of the costly high pressure container 2 and as a result allowing for a marked increase in productivity and mass production at a reduced cost. Further, the provision of the modular furnace unit which consists of the lower plug 4, heat insulating mantle 10, heater 14 and shield casing 12 or which omits the lower plug 4 as shown in FIG. 5, hermetically enclosed in the shield casing 12, and the valve 16 is advantageous in auxiliary operations such as loading and unloading of the workpiece 8, suctioning to vacuum or gas replacement, retention and drop of the temperature and pressure and can facilitate handling in these operations, contributing to shortening the time period for performing a series of operations of the HIP system. Moreover, there is no need for providing a valve of a high-pressure resistance construction as in conventional modular furnace units. The valve 16 provided in the shield casing 12 according to the present invention can have a pressure resistance of approximately 1 atm. and may be of an extremely simple construction which can ensure both reliable operation and a prolonged service life. Thus, the present invention can improve the productivity of the HIP system to a significant degree.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A hot isostatic pressing system of the type which includes a high pressure container with top and bottom plugs for closing open and top ends thereof or a high pressure container closed at a first end and having a plug for closing an end opposite said first end thereof, and a high pressure and temperature processing chamber defined in said pressure container and having a heat insulating mantle and a heater disposed around the inner periphery thereof for subjecting a workpiece supported on the plug to sintering or other treatment in a high pressure and temperature gas atmosphere in said processing chamber, said system comprising:

a removable shield casing hermetically engageable with the workpiece-supporting plug and which is loadable into and unloadable from said high pressure container along with said workpiece while holding said processing chamber in a sealed state; and a valve member provided in said shield casing for selectively establishing and blocking communication of said processing chamber with an exterior atmosphere such that said processing chamber is selectively placed in a vacuumized state, filled with a high pressure gas and evacuated to an atmospheric pressure.

2. The hot isostatic pressing system as set forth in claim 1, wherein the lower plug closing the bottom end of said high pressure container further comprises a double plug having an inner plug portion for supporting said workpiece and an outer plug portion fitted around the circumference of said inner plug portion and which is hermetically engageable with a lower end portion of said shield casing.

3. The hot isostatic pressing system as set forth in claim 1, wherein said lower plug further comprises a mounting block for supporting said workpiece thereon.

4. The hot isostatic pressing system as set forth in claim 1, wherein said shield casing is disposed on an outer side portion of said heat insulating mantle.

5. The hot isostatic pressing system as set forth in claim 4, wherein said shield casing further comprises an outer shell portion of said heat insulating mantle.

6. The hot isostatic pressing system as set forth in claim 1, wherein said shield casing is disposed on an inner side portion of said heat insulating mantle.

7. The hot isostatic pressing system as set forth in claim 1, wherein said valve member is provided in a top wall portion of said shield casing.

8. The hot isostatic pressing system as set forth in claim 1, wherein said valve member further comprises a valve port, a valve body having a valve stem and means for automatically opening said valve body upon loading into said pressure container and which further comprises means for depressing said stem of said valve body in a direction of opening said valve port.

9. The hot isostatic pressing system as set forth in claim 1, wherein said shield casing further comprises a seal plate located on a bottom side thereof, and said valve member is provided in said seal plate.

* * * * *